United States Patent [19]

Christensen et al.

[11] 4,277,002

[45] Jul. 7, 1981

[54] ICE DISPENSING MECHANISM

[75] Inventors: Donald R. Christensen; Ralph F. Stanford, both of Albert Lea, Minn.

[73] Assignee: King-Seeley Thermos Co., Prospect Heights, Ill.

[21] Appl. No.: 57,315

[22] Filed: Jul. 13, 1979

[51] Int. Cl.[3] ..... G01F 11/10

[52] U.S. Cl. ..... 222/349; 222/361

[58] Field of Search ..... 221/264, 260, 302; 222/349, 361, 362, 406; 62/344

[56] References Cited

U.S. PATENT DOCUMENTS

| | | | |
|---|---|---|---|
| 2,342,039 | 2/1944 | Davis | 222/349 X |
| 2,852,167 | 9/1958 | Lempart | 222/361 X |
| 3,561,231 | 2/1971 | Webb | 62/344 |
| 3,704,816 | 12/1972 | Gandrud | 222/406 X |

*Primary Examiner*—Stanley H. Tollberg
*Attorney, Agent, or Firm*—Harness, Dickey & Pierce

[57] ABSTRACT

An ice dispensing mechanism for use with an ice dispensing machine having an ice storage area and a transfer path for communicating ice from the storage area to the dispensing mechanism; the dispensing mechanism includes first and second enclosures which are arranged subjacent the ice storage area, the first enclosure being adapted to receive ice from the ice storage area, and the second ice enclosure being adapted to receive ice in metered quantities from the first enclosure and move from a position arranged generally vertically below the first enclosure to a second position disposed laterally therefrom wherein the ice within the second enclosure may drop downwardly under the influence of gravity into a suitable ice receptacle or the like. The first enclosure is provided with a resilient deformable wall which prevents ice being dispensed from damaging the mechanism as the second enclosure is transferred between its ice receiving position and its ice dispensing position, with the second enclosure also being provided with a resilient deformable wall which prevents ice being dispensed from damaging the second enclosure as it is moved to and from the aforesaid positions.

21 Claims, 9 Drawing Figures

ICE DISPENSING MECHANISM

BACKGROUND AND SUMMARY OF THE INVENTION

The present invention relates generally to dispensing devices for dispensing metered quantities of materials, and more particularly, to a new and improved dispensing device for dispensing metered quantities of ice in cube or similar form.

It has heretofore been the practice in the design of dispensing-type ice making machines or in dispensing devices for dispensing ice from a suitable reservoir or mass thereof, to provide some type of a shutter arrangement which may be selectively opened and closed in order to effect communication between an ice transfer path which extends between the ice mass (or discharge area of the ice making machine) and a suitable dispensing area into which receptacles, such as drinking glasses or the like, may be placed for receiving ice transferred along the path. While such shutter-like arrangements have been satisfactory for many applications, one particular problem associated therewith is the inability in many instances of the shutter to accurately control the dispensing of metered quantities of ice, such as that which may be required for a single drinking glass. Additionally, such prior art arrangements have been subject to the objectionable characteristics that frequently ice which is being dispensed may inadvertently become lodged between the periphery of the discharge path or discharge opening and the edge of the shutter as it moves to a closed position, thereby possibly damaging the dispensing mechanism. Many proposals have been made to rectify these problems; however, none of the arrangements in the prior art of which the inventors hereof are aware provide a satisfactory solution to these problems in a simple and straightforward manner and which will provide for the economies of mass production and the longevity of operational life required of modern ice dispensing equipment.

The present invention is intended to overcome the aforementioned objectionable areas of similar type of ice dispensing equipment heretofore known and used through the provision of a novel dispensing mechanism which incorporates a pair of cooperable ice enclosure members. The first of these members is adapted to be disposed generally below a mass of ice stored within a suitable ice reservoir, container, etc., and provide a flow path from such container to the second enclosure which is disposed generally below the first enclosure and is mounted for sliding movement between a first position receiving metered quantities of ice from the first enclosure and a second position wherein the ice is dispensed into a suitable receptacle. Both of the enclosures are provided with resilient wall means which, in the event ice inadvertently lodges between the enclosure members, deform or deflect to prevent damage to the mechanism. The volumes of the enclosures are selected so as to provide the desired quantity of ice to be dispensed during a single dispensing operation or cycle, whereby to accurately control the amount of ice dispensed, as will hereafter be described in detail.

It is accordingly a general object of the present invention to provide a new and improved ice dispensing mechanism.

It is a more particularly object of the present invention to provide a new and improved ice dispensing mechanism which functions to dispense metered quantities of ice in cube or similar form.

It is another object of the present invention to provide a new and improved ice dispensing mechanism which is positive in operation and will be resistant to damage in the event ice becomes lodged or jammed between the relatively movable parts thereof.

It is still another object of the present invention to provide a new and improved ice dispensing mechanism which is of a relatively simple design, is economical to manufacture and will have a long and effective operational life.

Another object of the present invention is to provide an ice dispensing mechanism, as above described, which may be manufactured in accordance with the applicable sanitary standards imposed upon the ice making and dispensing industry.

Other objects and advantages of the present invention will become apparent from the following description taken in conjunction with the accompanying drawings.

DESCRIPTION OF A PREFERRED EMBODIMENT

Figure 1:
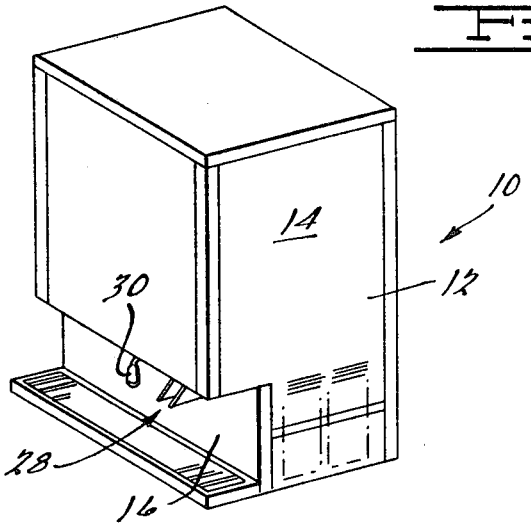
FIG. 1 is an elevated perspective view of an ice dispensing machine incorporating the ice dispensing mechanism of the present invention.

Referring now in detail to the drawings and in particular to FIG. 1 thereof, an ice dispensing machine 10, in accordance with one preferred embodiment of the present invention, discloses a generally upright enclosure 12 having an upper ice storage section 14 and a lower ice dispensing section 16. The dispensing section 16 may be recessed somewhat whereby to receive ice receiving receptacles, such as a drinking glass or the like, as is well known in the art. The ice storage section 14 may, if desired, consist merely of an ice reservoir or storage container, and/or may contain an ice making machine, and the principles of the present invention are intended to be equally applicable to the dispensing machine 10 functioning either as a dispensing unit for ice which is produced remotely therefrom, or for ice which is produced therewithin, as will be appreciated by those skilled in the art.

Figure 2:
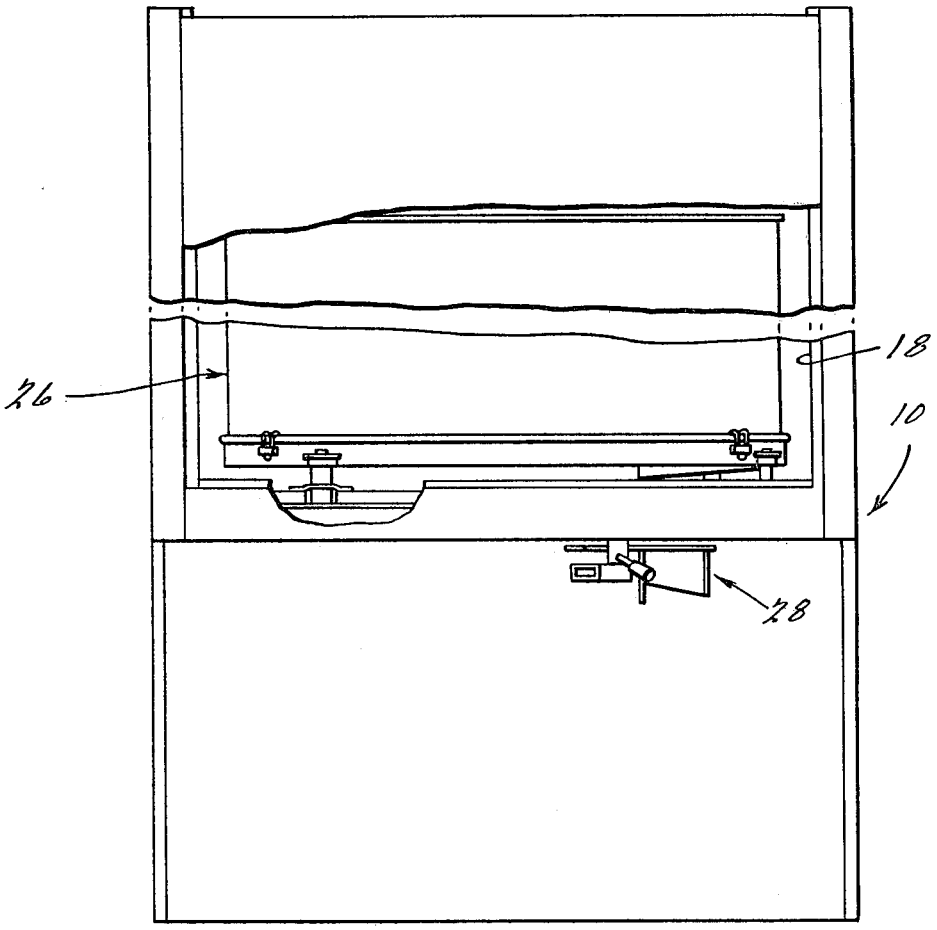
FIG. 2 is a front elevational view, partially broken away, of the ice dispensing machine shown in FIG. 1.
Figure 3:
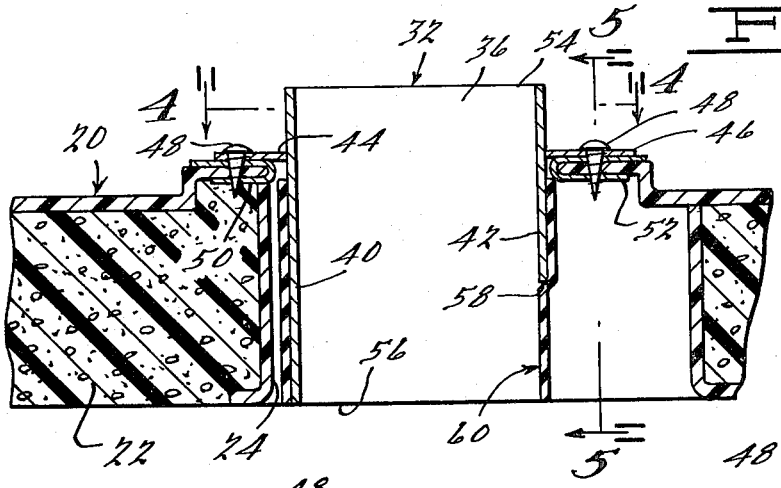
FIG. 3 is an enlarged fragmentary cross-sectional view of a portion of the first enclosure member incorporated in the ice dispensing mechanism of the present invention.

As best seen in FIGS. 2 and 3, the section 14 of enclosure 12 includes a bottom wall structure which is arranged generally horizontally and is designated by the numeral 20. The wall structure 20 includes a layer of suitable insulation 22 and defines a generally vertically extending opening 24. Disposed above the bottom wall structure 20 is an ice storage container 26 having a discharge opening (not shown) which is communicable with the opening 24 and via which ice is adapted to pass under the influence of gravity or due to the action of a suitable ice agitating or moving mechanism disposed within the container 16, such as, for example, is shown in U.S. patent application Ser. No. 921,837, filed July 3, 1978, owned by the same assignee as the assignee of this invention.

In accordance with the principles of the present invention, the ice dispensing machine 10 is provided with an ice dispensing assembly or mechanism, generally designated by the numeral 28, which is adapted to dispence ice in metered quantities from the ice storage container 26 into suitable ice receptacles, such as drinking glasses, which are disposed within the ice dispensing section 16 of the enclosure 12. The dispensing assembly 28 of the present invention is adapted to be actuated by means of a suitable manually engageable handle 30, whereby to cause the aforesaid metered quantities of ice to be selectively dispensed into the ice receptacles. It is to be noted that while the handle 30 is shown as being of the manually operated type, the present invention is not intended to be limited to this specific application since actuation of the dispensing mechanism 28 of the present invention may be achieved mechanically, either with a motor operated drive, an electrical solenoid operated mechanism or the like, as will be appreciated by those skilled in the art.

Figure 4:
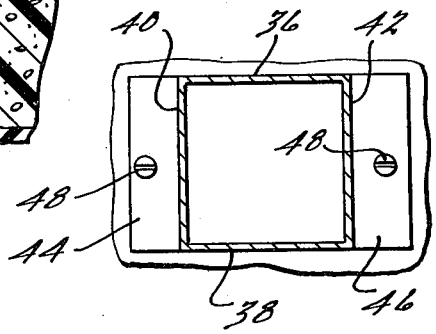
FIG. 4 is a transverse cross-sectional view taken substantially along the line 4—4 of FIG. 3.
Figure 5:
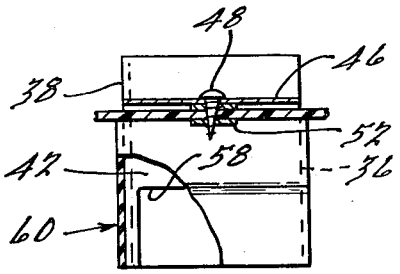
FIG. 5 is a vertical cross-sectional view taken substantially along the line 5—5 of FIG. 3.

Generally speaking, the ice dispensing mechanism 28 of the present invention comprises a pair of ice enclosures, generally designated by the numerals 32 and 34. The first enclosure 32, which essentially consists of an ice spout, is arranged generally vertically within the opening 24 of the bottom wall structure 20 and includes a pair of generally vertically arranged, spaced parallel side sections 36 and 38 between which extend another pair of generally vertically extending spaced parallel side sections 40 and 42, the side sections 36, 38 being arranged at generally right angles with respect to the side sections 40, 42, as best seen in FIG. 4. The enclosure 32 is provided with a pair of generally horizontally disposed, outwardly extending mounting flanges 44 and 46 which are adapted to be secured by means of suitable fastening elements 48 and U-shaped mounting clips or brackets 50, 52 to opposed peripheral edge portions of the opening 24, whereby the enclosure 32 is fixedly secured in a generally vertically extending position shown in FIG. 3. As shown in FIG. 3, the enclosure 32 defines a generally vertically arranged ice transfer path which is open at the upper end thereof, as indicated by the numeral 54, and at the lower end thereof, as indicated by the numeral 56, whereby ice may be transferred from the storage container 26 vertically downwardly through the enclosure 32 into the enclosure 34 in a manner hereinafter to be described.

In accordance with one of the principles of the present invention, the side section 42 of the enclosure 32 is cut away, as seen at 58, and the exterior of the enclosure 32 is provided with a band of resilient material, generally designated by the numeral 60. As shown in FIGS. 3 and 4, the band 60 extends entirely around the enclosure 32 and generally vertically from the lower end thereof upwardly to a position adjacent to the outwardly extending mounting flanges 44, 46. The band is intended to provide a resilient or deformable wall for the cut-away portion 58 of the enclosure 32, whereby to prevent damage to the enclosure 32 and the enclosure 34 in the event ice becomes jammed therebetween during an ice dispensing operation, as will hereinafter be described. The band 60 may be fabricated of any suitable resilient material, such as natural or synthetic rubber, or a suitable resilient polymeric material having the requisite sanitary characteristics required of equipment for dispensing materials which are to be ingested by human beings.

Figure 6:
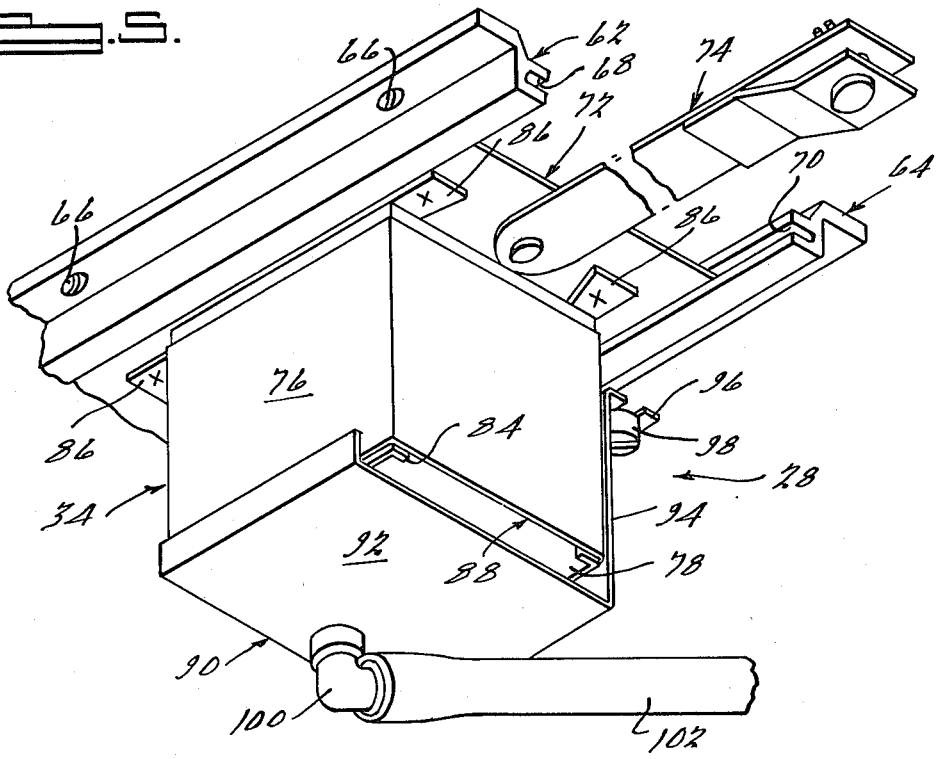
FIG. 6 is an elevated perspective view of the enclosure members embodied in the ice dispensing mechanism of the present invention.
Figure 7:
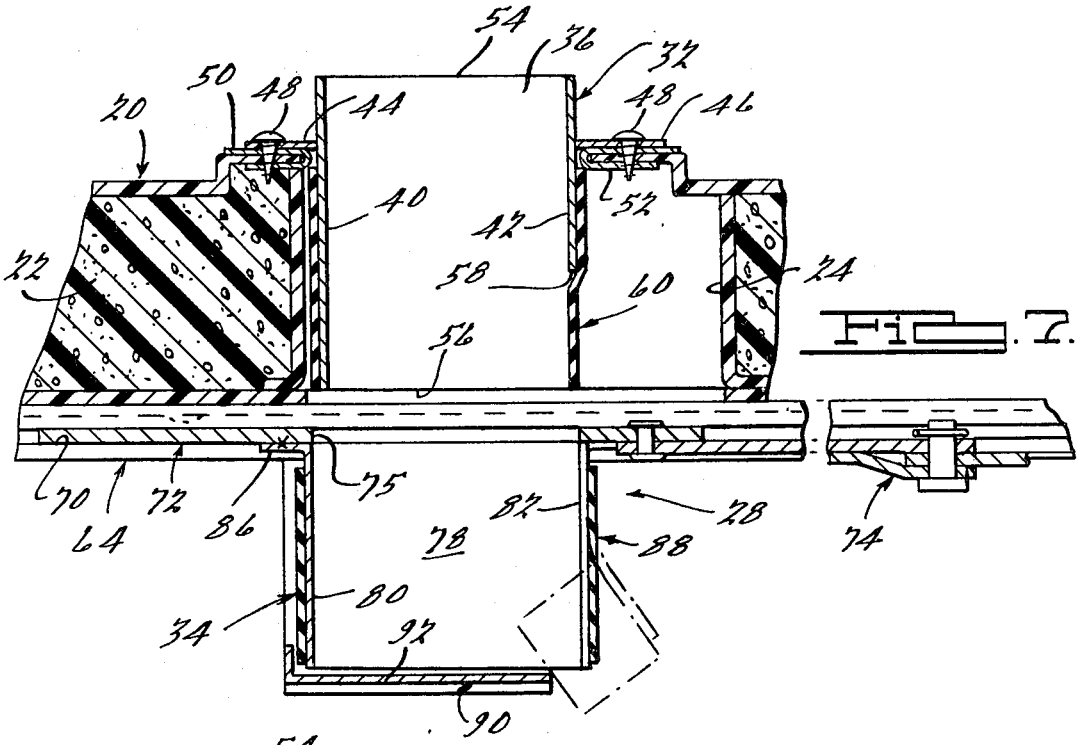
FIG. 7 is an enlarged transverse cross-sectional view, similar to FIG. 3, and illustrates both the first and second enclosure members of the ice dispensing mechanism of the present invention, with the resilient wall of the second enclosure shown in its normal position, and in phantom, in its distended position.
Figure 8:
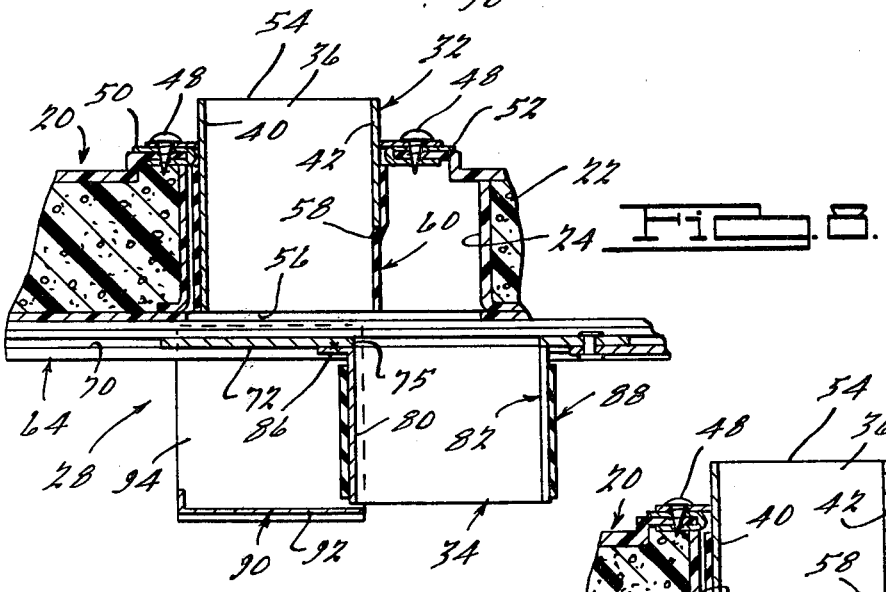
FIG. 8 is a view similar to FIG. 7 with the second enclosure member disposed in a dispensing position.

As best seen in FIG. 6, fixedly secured to the underside of the bottom wall structure 20 is a pair of spaced parallel slideways or tracks, generally designated by the numerals 62 and 64. The slideways 62, 64 are fixedly secured by suitable screws, bolts or similar fastening elements 66 to the underside of the wall structure 20 and define confronting recesses or slots 68, 70, respectively. The slideways 62, 64 are arranged generally parallel to the sides 36, 38 of the enclosure 32 and extend outwardly away from the side 42 of the enclosure 32. Slidably disposed and guided within the slots or recesses 68, 70 is a generally horizontally disposed transfer plate 72 which is adapted to be connected via suitable actuating linkage means 74 with the control handle 30. The transfer plate 72 is of a generally rectangular configuration and is formed with a generally rectangular opening 75 at one end thereof, the opposite end thereof being of sufficient size to prevent ice from passing downwardly through the open lower end 56 of the enclosure 32 when the plate 72 is disposed in a position shown in FIG. 8, and the rectangular opening 75 being adapted to be generally vertically aligned with the enclosure 32 when the plate is disposed in the position shown in FIG. 7 so that ice may pass downwardly through the opening 75 into the lower of the two enclosure members 34 which will hereinafter be described. Such sliding movement of the plate 72 between the position shown in FIG. 7 and the position shown in FIG. 8 is achieved through pivotal or other suitable movement of the handle 30 and resultant actuation of the linkage means 74, as will be described in connection with the overall operation of the ice dispensing mechanism 28 of the present invention.

Like the enclosure 32, the enclosure 34 defines a generally vertically arranged ice transfer path and comprises a pair of spaced parallel, vertically extending side sections 76 and 78 which are disposed parallel to the side sections 36, 38 of the enclosure 32. Extending generally transversely between the side sections 76, 78 is a back side section 80 which is arranged generally parallel to the side section 40 of the enclosure 32. The enclosure 34 also includes a forward side section 82 which is arranged generally parallel to the side section 42 of the enclosure 32 and is cut-away, as seen at 84, in FIG. 6. As shown in FIGS. 6–9, the upper end of the enclosure 34 is provided with generally horizontally extending mounting flange portions 86 which are adapted to be secured to the underside of the transfer plate 72, as by spotwelding or the like, at a position wherein the vertical ice transfer path defined by the enclosure 34 is generally vertically aligned with the rectangular opening 75 formed in the plate 72 so that ice may fall under the influence of gravity downwardly through the opening 75 and enclosure 34 during ice dispensing operation which will hereinafter be described. The enclosure 34 is also provided with a resilient deformable band, generally designated by the numeral 88, which extends entirely around the side sections 76, 78, 80 and 82 and provides a resilient deformable wall for the cut-away portion 84 of the forward side 82, as best shown in FIG. 7. The resilient band 88 extends generally the entire length or height of the enclosure 34 from a position adjacent the lower peripheral edge thereof to a position directly subjacent the mounting flange portions 86. The band 88 may be of the same material as the aforedescribed band 60.

Operatively associated with the lower enclosure 34 is a closure element, generally designated by the numeral 90. The element 90 includes a generally flat, horizontally arranged section 92 which is generally rectangular in shape and is of generally the same transverse cross-sectional size as the enclosure 34 and functions to prevent ice disposed within the enclosure 34 from dropping downwardly out of the lower end thereof. The closure element 90 also includes a generally vertically extending section 94 which is affixed adjacent the lower end thereof to one edge of the horizontal section 92 and is provided with a horizontal flange 96 at the upper end thereof which is secured by means of suitable screws, bolts or the like 98 to the underside of the bottom wall structure 20, as best seen in FIG. 6. The horizontal section 92 of the closure element 90 is provided with a suitable drain fitting 100 therein which is communicable with a suitable drain conduit or the like 102, by which ice melt water or the like may be communicated from the upper side of the section 92 of the element 90 to a suitable drain line or the like associated with the ice dispensing machine 10.

In operation of the present invention, assuming the initial conditions that the lower enclosure 34 is disposed in the position shown in FIG. 7 and that ice from the ice storage container 26 has dropped downwardly into the enclosures 32 and 34, with such ice being prevented from dropping out of the lower end of the enclosure 34 by the closure element 90. At such time as it is desired to effect a vend cycle, the handle 30 is actuated, for example, by pivoting the handle 30 to effect actuation of the linkage means 74, whereby the transfer plate 72 and lower enclosure 34 affixed thereto will move from the position shown in FIG. 7 to the position shown in FIG. 8. When this occurs, the end of the transfer plate opposite that to which the enclosure 34 is secured will move into registry with the lower end of the upper enclosure 32, thereby preventing further ice from dropping downwardly from the lower end of the upper enclosure 32. Concomitantly, the lower end of the lower enclosure 34 will be opened as it moves out of registry with the closure element 90 so that the ice within the lower enclosure 34 may drop downwardly into a suitable ice receptacle, such as a drinking glass. After the ice vend is completed, the handle 30 may be again actuated (or be returned via a suitable return spring mechanism or the like, not shown), whereupon the transfer plate 72 and lower enclosure 34 will move from the position shown in FIG. 8 back to the position shown in FIG 7. When this occurs, the lower end of the enclosure 34 will be closed by the closure element 90, and the opening 75 in the transfer plate 72 will move into registry with the upper enclosure 32 where ice disposed within the enclosure 32 may drop downwardly into the enclosure 34 and the enclosure 32 may be replenished with ice from the associated ice storage container 36 preparatory to the next subsequent vend cycle.

Figure 9:
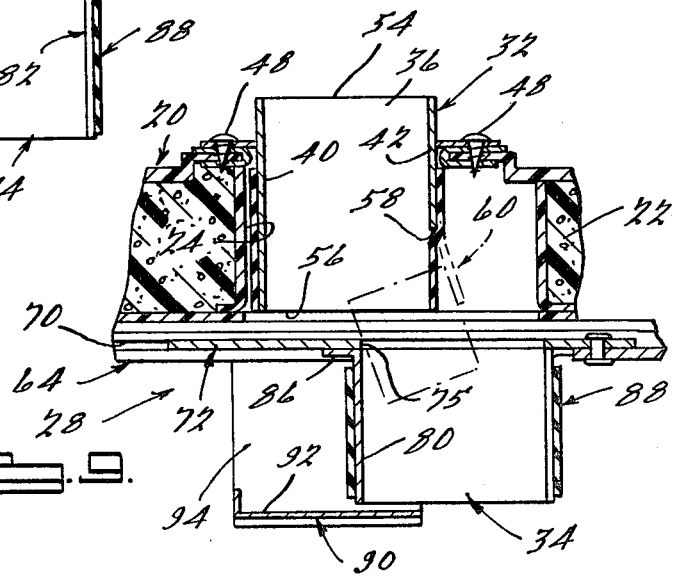
FIG. 9 is a view similar to FIG. 8 showing a portion of the resilient wall member of the first enclosure member disposed in its normal position and in the phantom distended position it would assume in the event an ice cube were lodged between the first and second enclosure members.

A particular feature of the present invention resides in the fact that the size of the enclosure members 32, 34 may be selected so that the desired metered quantity of ice may be dispensed with each vend cycle and that the sizes of the enclosures 32, 34 may be varied depending upon the particular application to which the ice dispensing mechanism 28 is made. Another important feature of the present invention resides in the provision of the resilient bands 60, 80 which are intended to prevent damage to the dispensing mechanism 28 in the event ice cubes become lodged between the enclosures 32, 34, or between the enclosure 34 and the closure element 90. In particular, and as shown in FIG. 9, in the event one or more ice cubes become lodged or partially transferred from the upper enclosure 32 to the lower enclosure 34 and a vend cycle is initiated, the band 60 will become distended or deformed so as to prevent damage to the walls of either the enclosures 32, 34. Similarly, in the event an ice cube is partially dispensed from the enclosure 34 and the transfer plate 72 is moved back to the position shown in FIG. 7, the enclosure 34 and closure element 90 are prevented from becoming damaged by virtue of the fact that the resilient band 80 will deform or deflect in the manner depicted in FIG. 7. As will be appreciated, during the next subsequent vend cycle, any ice which may inadvertently become lodged between either the resilient bands 60, 80 and the associated structures of the dispensing mechanism 28 will be easily dislodged without such structure in any way becoming damaged. Still another feature of the present invention resides in the extreme simplicity of the construction of the dispensing mechanism 28 of the present invention, which design permits the various component parts thereof to be fabricated of easily formed materials and of materials which are satisfactory from a sanitary standpoint. Typically, the materials of the enclosures 32, 34 might be stainless steel or the like. A related feature of the present invention resides in the fact that the extreme simplicity of operation assures for a long operational life, permits convenient cleaning and low maintenance.

While it will be apparent that the preferred embodiment of the invention disclosed is well calculated to fulfill the objects above stated, it will be appreciated that the invention is susceptible to modification, variation and change without departing from the proper scope or fair meaning of the subjoined claims.

We claim:

1. In combination in an ice dispensing machine including an ice storage area and means defining an ice transfer path having an ice inlet communicable with the ice storage area and an outlet from which ice may egress, an ice dispensing assembly including first and second enclosure means, said first enclosure means being communicable with the outlet of the ice transfer path and adapted to transfer ice to said second enclosure means, means supporting said second enclosure means for generally horizontally slidable drawer-like reciprocal movement along a sliding axis between an ice receiving position whereby ice is transferred from said first enclosure means to said second enclosure means, and an ice dispensing position whereby the ice within said second enclosure means may be dispensed into a suitable ice receptacle, and a generally vertically disposed deformable and compliant wall means on said second enclosure means arranged at generally right angles to said axis so as to be capable of deformably moving upon engagement with an ice article for preventing damage to said article and said assembly due to said ice article being dispensed thereby from becoming jammed or lodged therewithin as said second enclosure means is moved along said axis between said positions.

2. The invention as set forth in claim 1 which includes a second deformable wall means on said first enclosure means.

3. The invention as set forth in claim 1 wherein ice transferred from said ice storage area to said first enclosure means is transferred primarily under the influence of gravity.

4. The invention as set forth in claim 1 wherein the ice transferred from said first enclosure means to said second enclosure means is transferred primarily under the influence of gravity.

5. The invention as set forth in claim 1 wherein the ice transferred from said second enclosure means to said ice receptacle is transferred primarily under the influence of gravity.

6. The invention as set forth in claim 1 wherein said first enclosure means defines a generally vertically oriented ice transfer path from said ice storage area to said second enclosure means.

7. The invention as set forth in claim 6 wherein said second enclosure means defines a generally vertically oriented ice transfer path for communicating ice from said first transfer means to said ice receptacle.

8. The invention as set forth in claim 7 wherein said second enclosure means is movable along a generally horizontal axis between said first and second positions.

9. The invention as set forth in claim 8 which includes a resilient deformable wall on the same side of said first enclosure means as the direction of movement of said second enclosure means.

10. The invention as set forth in claim 8 which includes closure means fixedly mounted on said assembly for closing an opening in the lower end of said second enclosure means.

11. The invention as set forth in claim 10 wherein said closure means comprises a generally horizontally disposed panel.

12. The invention as set forth in claim 11 wherein said second enclosure means comprises a generally resilient deformable wall for preventing ice which may become jammed or lodged between said wall and said closure panel from damaging said assembly.

13. The invention as set forth in claim 11 which includes guideway means for slidingly supporting said second enclosure means for horizontal movement between said positions.

14. The invention as set forth in claim 12 wherein said resilient deformable wall is generally vertically oriented.

15. In combination in an ice dispensing machine including an ice storage area and means defining an ice transfer path having an ice inlet communicable with the ice storage area and an outlet from which ice may egress, an ice dispensing assembly including first and second enclosure means, said first enclosure means being communicable with the outlet of the ice transfer path and adapted to transfer ice to said second enclosure means, means supporting said second enclosure means for generally horizontally slidable drawer-like reciprocal movement along a sliding axis between an ice receiving position whereby ice is transferred from said first enclosure means to said second enclosure means, and an ice dispensing position whereby the ice within said second enclosure means may be dispensed into a suitable ice receptacle, and a first resilient deformable element on said first enclosure means and a second resilient deformable element on said second enclosure means for preventing damage to said article and said assembly due to said ice article being dispensed thereby from becoming jammed or lodged therewithin as said second enclosure means is moved along said axis between said positions.

16. The invention as set forth in claim 15 wherein said first enclosure means is of a generally rectangular shape in horizontal section.

17. The invention as set forth in claim 15 wherein said second enclosure means is of a generally rectangular shape in horizontal section.

18. The invention as set forth in claim 16 which includes a resilient deformable band extending entirely around said first enclosure means and wherein said first enclosure means has one side portion thereof removed wherein said deformable band comprises the sole means for retaining ice within said first enclosure means at said removed side portion thereof.

19. The invention as set forth in claim 17 which includes a resilient deformable band extending entirely around said second enclosure means and wherein said second enclosure means has one side portion thereof removed wherein said deformable band comprises the sole means for retaining ice within said first enclosure means at said removed side portion thereof.

20. In combination in an ice dispensing machine including an ice storage area and means defining an ice transfer path having an ice inlet communicable with the ice storge area and an outlet from which ice may egress, an ice dispensing assembly including first and second enclosure means, said first enclosure means being communicable with the outlet of the ice transfer path and adapted to transfer ice to said second enclosure means, means supporting said second enclosure means for generally horizontally slidable drawer-like reciprocal movement along a sliding axis between an ice receiving position whereby ice is transferred from said first enclosure means to said second enclosure means, and an ice dispensing position whereby the ice within said second enclosure means may be dispensed into a suitable ice receptacle, and said first enclosure means being disposed below said ice storage area, said second enclosure means being disposed below said first enclosure means, said first and second enclosure means being of generally rectangular cross-section, and which includes first and second generally resiliently deformable band-like elements extending around said first and second enclosure means, respectively, and comprise the sole means on selected vertical side portions thereof for retaining ice therein, said resilient deformable band means being compliant and deformable to prevent ice which may become jammed or lodged between said first and second enclosure means, or between said second enclosure means a lower closure element from damaging said assembly when said second enclosure means is moved between said positions.

21. In combination in an ice dispensing machine including an ice storage area and means defining an ice transfer path having an ice inlet communicable with the ice storage area and an outlet from which ice may egress, an ice dispensing assembly including first and second enclosure means, said first enclosure means being communicable with the outlet of the ice transfer path and adapted to transfer ice to said second enclosure means, means supporting said second enclosure means for generally horizontally slidable drawer-like reciprocal movement along a sliding axis between an ice receiving position whereby ice is transferred from said first enclosure means to said second enclosure means, and an ice dispensing position whereby the ice within said second enclosure means may be dispensed into a suitable ice receptacle, and a generally vertically disposed deformable and compliant wall means on at least one of said enclosure means and arranged at generally right angles to said axis so as to be capable of deformably moving upon engagement with an ice article for preventing damage to said article and said assembly due to said ice article being dispensed thereby from becoming jammed or lodged therewithin as said second enclosure means is moved along said axis between said positions, said wall means comprising a resilient deformable band extending entirely around said one enclosure means, with said one enclosure means having one side portion thereof removed so that the section of said band extending across the opening provided by said removed side portion comprises the sole means for retaining ice within said one enclosure means at said removed side portion thereof.

* * * * *